US008046884B2

(12) United States Patent
Dilo

(10) Patent No.: US 8,046,884 B2
(45) Date of Patent: Nov. 1, 2011

(54) DRIVE AND GUIDE DEVICE IN A NEEDLE LOOM

(75) Inventor: Johann Philipp Dilo, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 0 days.

(21) Appl. No.: 12/844,433

(22) Filed: Jul. 27, 2010

(65) Prior Publication Data

US 2011/0035914 A1 Feb. 17, 2011

(30) Foreign Application Priority Data

Aug. 14, 2009 (EP) ..... 09167924

(51) Int. Cl.
*D04H 18/00* (2006.01)

(52) U.S. Cl. ..... 28/107; 28/114

(58) Field of Classification Search ..... 28/107, 28/114, 115, 108–113; 112/80.42, 80.41, 112/80.4

See application file for complete search history.

(56) References Cited

U.S. PATENT DOCUMENTS

| | | | | |
|---|---|---|---|---|
| 202,252 | A * | 4/1878 | Field | 28/113 |
| 1,907,292 | A * | 5/1933 | Gladish | 112/80.15 |
| 2,004,709 | A * | 6/1935 | Phillips | 28/107 |
| 2,845,687 | A * | 8/1958 | Howard | 28/114 |
| 3,132,406 | A | 5/1964 | Smith, II | |
| 3,409,959 | A * | 11/1968 | Barboni | 264/119 |
| 3,681,823 | A * | 8/1972 | Dilo | 28/109 |
| 3,703,752 | A * | 11/1972 | Schulte | 28/109 |
| 3,877,121 | A | 4/1975 | Obenaus | |
| 4,241,479 | A | 12/1980 | Dilo | |
| 5,548,881 | A | 8/1996 | Ludwig | |
| 5,732,453 | A * | 3/1998 | Dilo et al. | 28/114 |
| 6,389,665 | B1 * | 5/2002 | Fuchs et al. | 28/114 |
| 2002/0162203 | A1 * | 11/2002 | Legl et al. | 28/114 |
| 2006/0048356 | A1 * | 3/2006 | Leger | 28/113 |
| 2009/0119894 | A1 * | 5/2009 | Reutter et al. | 28/114 |

FOREIGN PATENT DOCUMENTS

DE 102006008485 A1 8/2007

* cited by examiner

*Primary Examiner* — Amy Vanatta

(74) *Attorney, Agent, or Firm* — Jansson Shupe & Munger Ltd.

(57) ABSTRACT

The drive and guide device for a needle bar of a needle loom having a machine stand includes a first crankshaft rotatably supported in the machine stand; a needle bar supported in the machine stand; a first connecting rod supported on a first cam of the first crankshaft and connected to the needle bar; and a guide device for guiding the needle bar along a path extending perpendicular to the needle-punching support surface. The first connecting rod and/or the guide device comprises a leaf spring, which is rigidly connected to the needle bar to transmit a drive or guide force. As a result, lubrication points on elements of the needle loom which move from place to place are eliminated.

21 Claims, 2 Drawing Sheets

DRIVE AND GUIDE DEVICE IN A NEEDLE LOOM

CROSS REFERENCE TO RELATED APPLICATION

This application claims priority based on European patent application EP 09 167 924.1, filed Aug. 14, 2009.

FIELD OF THE INVENTION

The invention relates to a drive and guide device for a needle bar in a needle loom.

BACKGROUND OF THE INVENTION

The needle bar of a needle loom must be guided during its movement in the machine stand in a direction perpendicular or essentially perpendicular to the needle-punching support surface. The guide devices provided for this purpose, whether these be rails or rods, lead to problems with heat, lubrication, and sealing. Wear must be avoided as much as possible, because otherwise the punching accuracy during operation suffers. This is disadvantageous especially at high needle-punching densities.

A guide device for the needle bar in a needle loom containing at least one pair of rocker arms, which are arranged on opposite sides of the needle bar, is known from U.S. Pat. No. 4,241,479 A. One end of each of these arms is hinged to the needle bar, while a support device is present on the other end, which supports the rocker arm in question on the machine stand so that it is free to rock. For this purpose, a first bearing surface is formed on the machine stand for each rocker arm; this first bearing surface faces a second bearing surface on the end of the rocker arm. The bearing surface on the machine stand is designed in the manner of an involute gear recess, into which a tooth designed in complementary fashion on the opposite end of the associated rocker arm engages, the tooth thus being free to rock in the gear recess. In this way, the needle bar can be guided along a straight path, wherein the elements participating in its guidance perform exclusively rolling movements.

A needle loom in which the lateral guidance of the needle bar during its up and down stroke is provided by a symmetrically designed four-bar linkage, which is hinged to the needle bar or its carrier and to the machine stand, is known from DE 10 2006 008 485 A1. The dimensions of the four-bar linkage are chosen in such a way that the Ball's point which it forms and which lies on the needle bar describes a straight path within the stroke range of the needle bar.

Although the two previously described designs avoid the sliding type of guides, which are vulnerable to wear, they are relatively complicated mechanically. The two designs contain pivot bearings on the needle bar, which must be lubricated, and the latter design also has an additional number of non-stationary pivot bearings, which increases the difficulty of lubrication even more, because the lubricant must be supplied to these non-stationary pivot bearings continuously for as long as they are in operation.

SUMMARY OF THE INVENTION

It is an object of the present invention to provide a drive and guide device for a needle bar in a needle loom, which is simple technically and which makes do with a reduced number of lubrication points.

A preferred embodiment of the drive and guide device for a needle bar in a needle loom includes a machine stand and has a first crankshaft rotatably supported in the machine stand and a needle bar supported in the machine stand movable at least up and down. The drive and guide device also includes a first connecting rod supported on a first cam of the first crankshaft connected to the needle bar and a guide device for guiding the needle bar along a path extending substantially perpendicular to a needle-punching support surface. The first connecting rod and the guide device includes a leaf spring which is rigidly connected to the needle bar to transmit a drive or guide force. The first connecting rod can be rigidly connected to the needle bar and forms a rigid unit with it, whereas the guide device comprises a guiding leaf spring, which is rigidly anchored in the machine stand, and which extends on a level which is approximately the same as that of the needle bar in the needle loom.

In a another preferred embodiment, one end of a first connecting leaf spring is attached to the end of the first connecting rod facing away from the cam. This connecting spring comprises a second end, which is rigidly attached to the needle bar, and the guide device includes a second crankshaft, which is on approximately the same level as the needle bar in the machine stand and which has at least one second cam, on which a second connecting rod is supported, the end of this second rod facing away from the second cam is rigidly connected to the needle bar.

In an additional preferred embodiment, the first connecting rod is rigidly connected to the needle bar to form a single rigid unit, and the guide device comprises a second crankshaft, which is on approximately the same level as the needle bar in the machine stand and which has at least one second cam, on which a second connecting rod is supported. One end of a second connecting leaf spring is rigidly attached to the end of this second rod which faces away from the second cam, while the other end of the second connecting leaf spring is rigidly connected to the needle bar. With an arrangement such as this, a motion component in a direction parallel to the needle-punching support surface can be superimposed on the movement of the needle bar in the direction perpendicular to the base. During a punch, this parallel component follows the movement of the nonwoven web being processed on the needle loom.

In further preferred embodiments of the invention, a first connecting rod, which gives the needle bar the motion component in a direction perpendicular to the needle-punching support surface, is connected to the needle bar by a connecting leaf spring, which is rigidly connected at one end to the connecting rod, and at the other end to the needle bar. In comparison to a guiding leaf spring, which guides the needle bar during its punching movement, this connecting leaf spring is relatively short, which prevents it from buckling out to the side during the punching movement.

A connection between the connecting rod and the needle bar can also be realized for the second connecting rod, by which a motion component parallel to the needle-punching support surface is transmitted to the needle bar. Here too, the connecting leaf spring should be short enough to prevent it from buckling during operation.

The invention can also be used in needle looms which comprise two needle bars arranged parallel to each other, which are driven by first crankshafts individually assigned to them. Each needle bar can be guided individually from the side by a guiding leaf spring or by a second crankshaft with a second connecting rod and possibly a connecting leaf spring. It is also possible, however, for both needle bars to be guided by a single guiding leaf spring or by a single second crankshaft with a second connecting rod and possibly a connecting leaf spring, provided that the needle bars are coupled to each other. If the first crankshafts rotate in opposite directions, a single coupling leaf spring is sufficient to couple the needle bars together. If the first crankshafts rotate in the same direction, two coupling leaf springs arranged one above the other a certain distance apart are provided between the two needle bars, these springs being connected rigidly to the needle bars to prevent the needle bars from tipping toward each other uncontrollably.

To minimize the flexing of the connecting leaf spring and to increase its service life, the guiding leaf spring should be as long as possible. If in fact the guiding leaf spring is long, however, there is the danger that, during operation, the moving needle bar will cause it to oscillate and possibly to flutter. To avoid such undesirable action, the guiding leaf spring may be surrounded by a stiff guard which prevents the leaf spring from oscillating. A guard of this type can consist of two rails, which are parallel to each other and which rest on the narrow sides of the guiding leaf spring, the rails being connected to each other by several pairs of bars arranged a certain distance apart. The bars of each pair form a gap between them, through which the guiding leaf spring extends. The rails can be provided at their ends with buffers of plastic or rubber, because the ends of the rails can come into contact with the parts of the machine adjacent to them. The buffers dampen the noise which may develop during operation.

The needle bar of a needle loom is put in motion by at least two connecting rods. In the case of very large working widths, it is also possible for more than two connecting rods to be used. These connecting rods are set in motion by a corresponding number of cams on the associated crankshaft. The same applies to the guide devices. It should be appreciated that while the invention is explained on the basis of only a single connecting rod and one guide device, this should not be understood as a numerical limitation.

BRIEF DESCRIPTION OF THE DRAWINGS

In order that the advantages of the invention will be readily understood, a more detailed description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
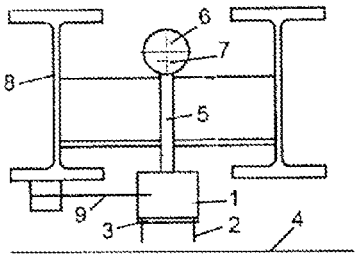
FIG. 1 is a schematic diagram of a drive and guide device according to the invention based on the example of a needle loom with one needle bar.

In the following, specific embodiments of the invention shown in the drawings are described in detail. The diagrams in the drawings are limited for the sake of clarity to the parts of a needle loom essential to the explanation of the invention.

FIG. 1 shows a portion of the needle loom including a needle bar 1, which carries on its bottom surface a needle board 3 equipped with needles 2. A needle-punching support surface 4 is set up opposite the needles. Needle-punching support surface 4 serves to support the web of material (not shown) to be needled. Such web of material may be a nonwoven web or the like which, during the operation of the needle loom, is transported through the needle loom transversely with respect to the longitudinal direction of the needle bar 1.

One end of a rigid first connecting rod 5 is rigidly connected to the side of the needle bar 1 facing away from the needles 2. The other end of the connecting rod is supported on a first cam 6 of a first crankshaft 7. The first crankshaft 7 is supported rotatably in a machine stand 8 of the needle loom, which also carries the needle-punching support surface 4.

To guide the needle bar 1 up and down with respect to the needle-punching support surface 4 during operation, one end of a flexible guiding leaf spring 9 is rigidly attached to the needle bar. The other end of this guiding leaf spring 9 is attached rigidly to the machine stand. 8.

During operation, the needle bar 1 is set into up-and-down motion with respect to the needle-punching support surface 4 by the first crankshaft 7, operating by way of the first cam 6 and the first connecting rod 5. As needle bar 1 executes this motion, it is guided by the elastic guiding leaf spring 9, which bends elastically over its entire length but especially near the points where it is clamped to the needle bar 1 and to the machine stand 8. Due to the stiffness of the first connecting rod 5 and its rigid connection to the needle bar 1 and due to restricting the needle bar 1 from sideways movement—a limitation which holds the bar in a position almost always directly below the first crankshaft 7—the needle bar 1 executes a tipping movement around its longitudinal axis, which also leads to elastic flexing of the guiding leaf spring 9. To minimize this tipping movement, the first connecting rod 5 should be as long as possible, that is, long in relation to the stroke of the needle bar 1. To minimize the bending stress of the guiding leaf spring 9, it should be as long as possible, that is, comparatively long in relation to the stroke of the needle bar.

Figure 2:
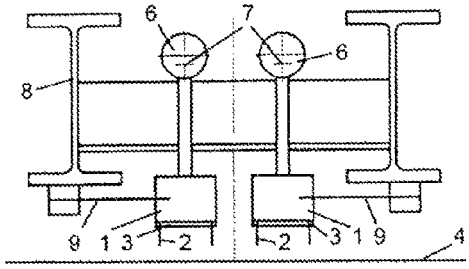
FIG. 2 is a schematic diagram of a drive and guide device according to the invention based on the example of a needle loom with two needle bars.

FIG. 2 shows an exemplary embodiment of the invention in which the invention is realized in a needle loom comprising two needle bars 1, which are arranged next to each other and which operate independently. Assigned to each needle bar 1 is its own punching drive, consisting of first crankshaft 7, operating by way of first cam 6 and first connecting rod 5. Each needle bar 1, furthermore, is rigidly connected to one end of an individual guiding leaf spring 9, the other end of which is rigidly clamped in the machine stand 8. The two arrangements are mirror images of each other. Their behavior during operation is completely comparable to that already explained above on the basis of the example of FIG. 1.

Figure 3:
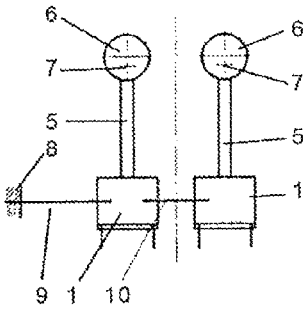
FIG. 3 is a schematic diagram of an alternative embodiment of a drive and guide device according to the invention based on the example of a needle loom with two needle bars.

FIG. 3 shows a schematic diagram of an embodiment of a needle loom with two needle bars 1, each of which has its own needle-punching drive, consisting of crankshaft 7, operating by way of cam 6 and connecting rod 5, in a manner completely comparable to the embodiment of FIG. 2. For the sake of clarity, the needle-punching support surface 4 and most of the machine stand 8 are not shown. The only part of the machine stand 8 shown is the point where, when one end of a guiding leaf spring 9 is clamped, the other end is rigidly connected to one of the needle bars 1, in the present case the needle bar 1 shown on the left hand side of the drawing. The two needle bars 1 are connected to each other on their facing sides by an elastic coupling leaf spring 10, which is rigidly attached to the two needle bars 1.

During operation, the rotation of the first crankshaft 7 leads to a rising and falling movement of the needle bars 1. In addition, due to the rigid connection of the stiff first connecting rod 5 to the needle bars 1 and the limitation on the movement of the bars by the guiding leaf spring 9 and the coupling leaf spring 10, needle bars 1 are tipped around their longitudinal axes, i.e., to the right and to the left in the drawing. The lateral guidance of the needle bar 1 shown on the left in the drawing is provided by the guiding leaf spring 9 attached to it, which behaves in the same way as guiding leaf springs 9 shown in FIGS. 1 and 2. As shown in FIG. 3, the lateral guidance of needle bar 1 shown on the right in the drawings is provided by the elastic coupling leaf spring 10.

If the two first crankshafts 7 turn in the same direction, the coupling leaf spring 10 flexes into the shape of an "S", that is, it bends in two opposite directions, because the needle bars tip in the same direction. If the two first crankshafts 7 turn in opposite directions, the coupling leaf spring 10 bulges out in only one direction, that is, first in the upward direction and then in a downward direction, which means that it is subject to less bending stress than that present in the first-mentioned operational variant. Counter-rotating operation of the first crankshafts 7 is preferred as it is easier to balance the inertia within the needle loom.

Figure 4:
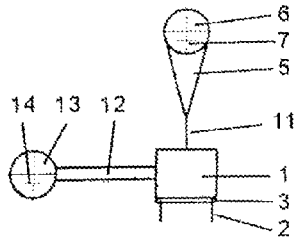
FIG. 4 is a schematic diagram of a drive and guide device according to the invention based on the example of a needle loom in which a single needle bar has a first drive, which produces the actual punching action, and a second drive, which can move the needle bar horizontally.

FIG. 4 shows another embodiment of the invention, which differs from the previously described embodiments primarily in that the unit consisting of first connecting rod 5, which is moved by first cam 6 of first crankshaft 7, and the needle bar 1 is not rigid. Instead, an elastic connecting leaf spring 11 is inserted between the free end of the connecting rod 5 and the needle bar 1. The connecting leaf spring 11 is rigidly connected at one end to the first connecting rod 5 and at the other to the needle bar 1. Connecting leaf spring 11 transmits the thrust forces for punching coming from the crankshaft 7 and is relatively short so that it does not buckle to the side under the effect of the thrust forces mentioned.

The lateral guidance of the needle bar 1 can in this case be accomplished by a guiding leaf spring 9 of the type shown in FIG. 1. This variant is not shown in the example of FIG. 4, but will be understood to be possible by one skilled in the art.

FIG. 4 shows, in contrast, a variant for the lateral guidance of the needle bar 1 by means of a second connecting rod 12, which is moved by a second crankshaft 14 supported in the machine stand (not shown), acting by way of a second cam 13. The second crankshaft 14 is arranged on approximately the same level as the needle bar 1. The second connecting rod 12 and the needle bar together form a rigid unit. A rotation of the second crankshaft 14 at the same speed as that of the first crankshaft 7 is able superimpose a motion component oriented parallel to the needle-punching support surface onto the punching motion of the needle bar oriented essentially perpendicular to the base (not shown). During the time that the needles 2 remain in the web to be processed, this parallel component proceeds in the same direction as that of the web through the needle loom. Although it is true that, during this movement, the needle bar 1 also tips slightly around its longitudinal axis as a result of the rigid connection between the second connecting rod 12 and the needle bar 1, nevertheless, if the second connecting rod 12 is long enough, the tipping angle is so small that it does not produce any noticeable disadvantageous effect in the processed web of material. A "long" connecting rod in this context means long with respect to the stroke of the needle bar 1. The previously mentioned tipping movements of the needle bar 1 are absorbed by the elastic connecting leaf spring 11, which flexes under the effect of the tipping movements.

Figure 5:
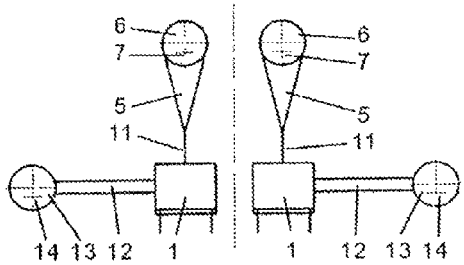
FIG. 5 is a schematic diagram of a drive and guide device according to the invention based on the example of a needle loom in which each of the two needle bars has its own first drive, which produces the actual punching action, and a second drive, which can move the needle bars horizontally.

In a manner fully comparable to that shown in FIGS. 1 and 4, FIG. 5 shows the application of the features explained on the basis of the example of FIG. 4 to a needle loom with two needle bars 1 arranged next to each other. Each needle bar 1 has its own first drive for the needle-punching movement, consisting of a first crankshaft 7, a first cam 6, a first connecting rod 5, and a connecting leaf spring 11. In addition, each needle bar 1 has a second drive for the horizontal motion component oriented parallel to the needle-punching support surface 4 (not shown). The second drive consists of a rigid second connecting rod 12, rigidly attached to the needle bar 1, and a second cam 13 on a second crankshaft 14, which is mounted on approximately the same level as the needle bar 1. The arrangements are mirror images of each other. The way they function is the same as that described above in relation to the embodiment of FIG. 4.

Figure 6:
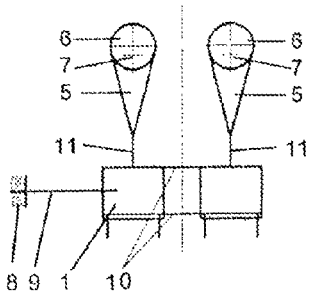
FIG. 6 shows an embodiment of the invention similar to that of FIG. 3 with an elastic connection between the needle bar and the connecting rod producing the punching movement.

FIG. 6 shows an exemplary embodiment of the invention which is comparable to that of FIG. 3 with respect to function but which requires that the first crankshafts 7 turn in the same direction. It also differs in design from the embodiment in FIG. 3 in that each of the first connecting rods 5 are connected to the needle bar 1 by way of an elastic connecting leaf spring 11—similar to the embodiment of FIGS. 4 and 5. Another difference versus the embodiment of FIG. 3 is that the guidance of the needle bar 1 shown on the right in FIG. 6 is provided by two elastic coupling leaf springs 10, which are arranged one above the other a certain distance apart, and each of which is rigidly connected to the needle bars 1. Two coupling leaf springs 10 are required as a result of the elastic connection between first connecting rods 5 and needle bar 1. In this embodiment, a certain freedom of movement is restrained which cannot be limited sufficiently by only a single coupling leaf spring according to the example of FIG. 3.

Figure 7:
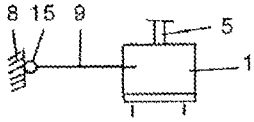
FIG. 7 is a schematic diagram of an alternative embodiment of the connections of a guiding leaf spring.

In the preferred embodiments described on the basis of FIGS. 1-3 and 6, both ends of the guiding leaf spring 9 are clamped rigidly in position, one end on the needle bar 1 and the other on the machine stand 8, and in the bent states, i.e., when the needle bar is in its upper and lower end positions, the spring assumes a slightly "S"-like shape. According to the variant shown partially in FIG. 7, the bending stress of the guiding leaf spring 9 can be reduced by supporting one end in a pivot bearing 15. Preferably pivot bearing 15 is lubricated for life, that is, a bearing which requires little or no maintenance. In this case, the guiding leaf spring 9 shows only a simple form of flexure in the end positions of the needle bar 1, and its overall bending stress is reduced in comparison with that present in the previously described exemplary embodiments.

Figure 8:
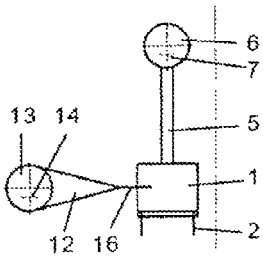
FIG. 8 shows an embodiment similar to FIG. 1, including a second drive, which gives the needle bar a motion component perpendicular to the punching motion, with an elastic connection between the needle bar and the connecting rod of the second drive.

FIG. 8 shows another preferred embodiment of the invention. This is similar to the exemplary embodiment of FIG. 1 to the extent that the needle-punching drive of the needle bar 1 consists of a first crankshaft 7, which is connected to the needle bar 1 by way of a first cam 6 and a first connecting rod 5 rotatably supported thereon. The connecting rod 5 and the needle bar 1, similar to the preferred embodiment of FIG. 1, form a rigid unit. For the guidance of the needle bar 1 during its punching movement, a second crankshaft 14 is provided, which is rotatably supported in the machine stand (not shown) on approximately the same level as the needle bar 1. The second crankshaft 14 has a second cam 13, on which a second connecting rod 12 is rotatably supported. The second connecting rod 12 has a free end, which is connected to the needle bar 1 by a second elastic connecting leaf spring 16. The second connecting leaf spring 16 has ends, one of which is rigidly connected to the needle bar 1, the other to the free end of the second connecting rod 12. With this design, a motion component oriented parallel to the needle-punching support surface (not shown in FIG. 8) can be superimposed on the punching movement of the needle bar in a manner completely comparable to the example of FIG. 4. Such parallel movement again follows the forward movement of the web being processed in the needle loom during the time that the needles 2 remain in the web. The second connecting leaf spring 16 makes it possible for the needle bar to execute the tipping movements versus the needle-punching support surface which occur during operation as a result of the cams 6 and 13 acting by way of the connecting rods 5 and 12. Again, the connecting rods 5 and 12 should be long in relation to the stroke of the needle bar 1 to minimize such tipping movements.

Figure 9:
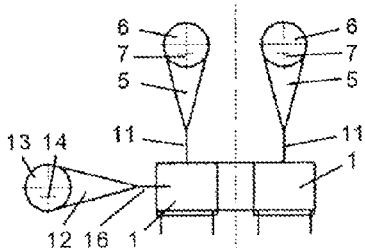
FIG. 9 shows an embodiment of the invention similar to FIG. 6 with a second drive which is connected to the needle bar.

The exemplary embodiment of FIG. 9 shows a needle loom with two needle bars arranged next to each other, which are connected to each other by two elastic coupling leaf springs 10. To this extent and also with respect to the needle-punching drives of the needle bars, this embodiment is the similar to that of FIG. 6. The embodiment of FIG. 9 differs from that of FIG. 6 in that it adds a second drive to the two needle bars 1, namely, a drive which gives the needle bars 1 a motion component parallel to the needle-punching support surface (not shown), as described on the basis of the example of FIG. 8. The second drive comprises a second crankshaft 13, supported in the machine stand on approximately the same level as the needle bar 1, this crankshaft carrying a second cam 14, on which a second connecting rod 12 is rotatably supported. The free end is connected to one of the needle bars 1, namely, to the needle bar 1 shown on the left in the drawing, by means of a second connecting leaf spring 16. The second connecting leaf spring 16 has two ends, one of which is rigidly connected to the second connecting rod 12, the other to the previously mentioned needle bar 1. The second connecting leaf spring 16 makes it possible for the left needle bar 1 to execute the tipping movements versus the needle-punching support surface which occur during operation as a result of the cams 6 and 13 acting by way of the connecting rods 5 and 12, whereas the coupling leaf springs 10 make it possible for the two needle bars 1 to move with respect to each other. Again, the connecting rods 5 and 12 should be long in relation to the stroke of the needle bar 1 to minimize the previously mentioned tipping movements. To increase the stiffness, the needle bars 1 could be connected here by a diagonal strut (not shown), located in the area between the coupling leaf springs 10. It is also contemplated that the interior area between the two needle bars 1 could be filled in completely by a wall of sheet metal, for example, to increase the stiffness.

It can be seen from the examples shown and explained above that the concept of the rigid connection between connecting rods and needle bars and the use of elastic leaf springs for guidance and also in the drive of the needle bars can be implemented in any desired way as long as it is ensured that at least one elastic leaf spring is used either to guide the needle bar or as part of the needle-punching drive. As a result of the invention, the need for lubrication is completely eliminated at least on the needle bar, which considerably reduces the effort required to lubricate the interior of the machine, as there is no need to introduce lubricant to the moving parts of the machine.

As has been explained above, it is desirable that the guide element, whether it be a second connecting rod with a second connecting leaf spring or a guiding leaf spring, be as long as possible in relation to the stroke of the needle bar. If the guide element is a guiding leaf spring 9, it can easily, because of its length, start to oscillate under the effect of the up-and-down movement of the needle bar 1. To suppress such natural oscillations, a guard 17, which is shown in FIG. 10 and a detail of which is shown on a larger scale in FIG. 11, is provided according to an elaboration of the invention.

Figure 10:
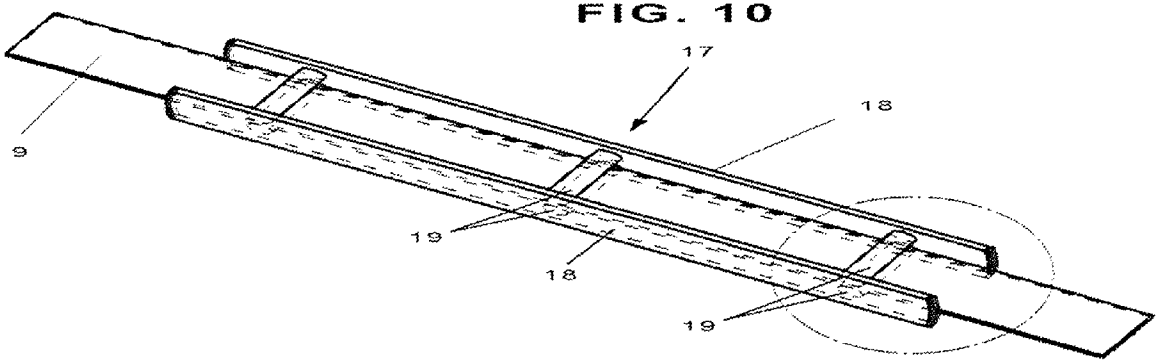
FIG. 10 is a perspective view of a guard surrounding the leaf spring to prevent the leaf spring from fluttering.
Figure 11:
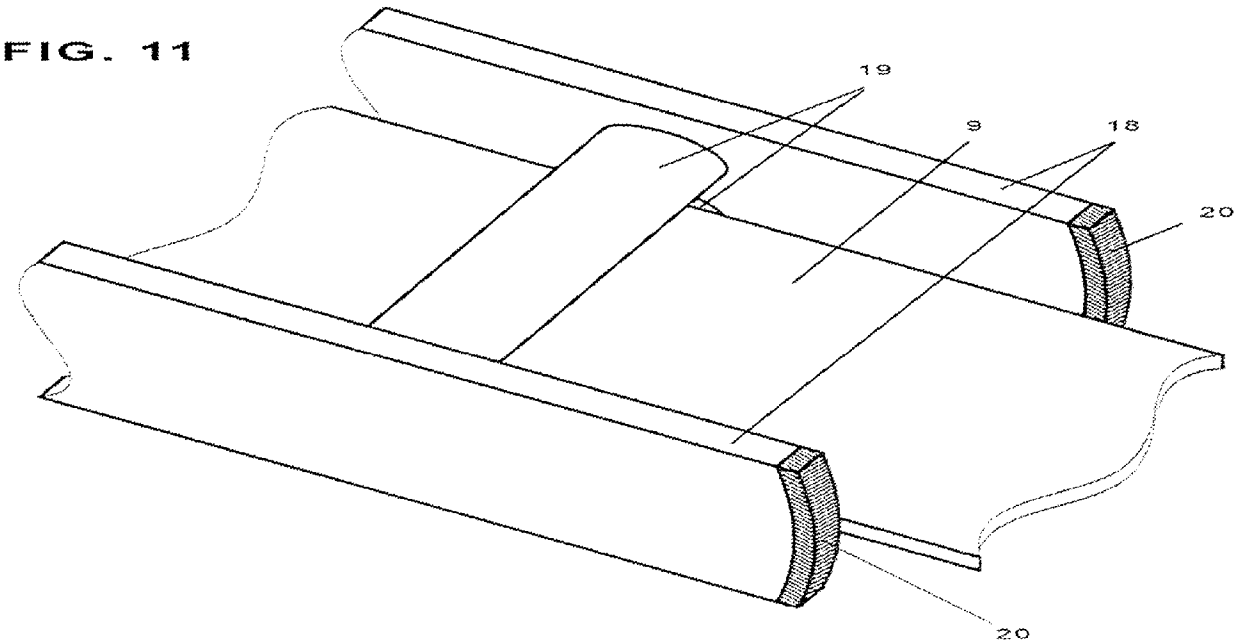
FIG. 11 is an enlarged view of the circled area in FIG. 10.

According to FIG. 10, the preferred embodiment with a guard 17 for a guiding leaf spring 9 consists of two stiff rails 18, which are arranged parallel to each other and which are connected to each other by several pairs of rods 19. The connecting rods 19 of one pair form a gap, through which the guiding leaf spring 9 extends, and the longitudinal edges of the spring rest on the rails 18. If the rails 18 are flat, at least three pairs of connecting rods 19 must be present, as shown in FIG. 10, to suppress the natural oscillations of the guiding leaf spring 9. If the stroke frequency of the needle bar 1 arrives in a range in which the guiding leaf spring 9 could be caused to oscillate harmonically, the number of pairs of connecting rods 19 will have to be increased correspondingly.

Alternatively, the rails 18 could have a C-shaped cross section, wherein the side pieces of the rails face each other. If the guiding leaf springs 9 are embedded in soft plastic or rubber provided in the groove between the side pieces of a rail 18, the connecting rods 19 can then under certain conditions be omitted entirely. The leaf spring in this case has sufficient freedom to flex in the groove and yet is still securely supported.

Because the ends of the guard 17 can come in contact with adjacent machine parts, the ends of the rails 18 are preferably provided with buffers 20 of rubber or plastic to dampen the noise which would otherwise occur during operation.

Reference throughout this specification to "one embodiment," "an embodiment," "a preferred embodiment," "alternate embodiment" or similar language means that a particular feature, structure, or characteristic described in connection with the embodiment is included in at least one embodiment of the present invention. Thus, appearances of the phrases "in one embodiment," "in an embodiment," "in a preferred embodiment," "in an alternate embodiment," and similar language throughout this specification may, but do not necessarily, all refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

While the present invention has been described in connection with certain exemplary, alternate or specific embodiments, it is to be understood that the invention is not limited to the disclosed embodiments, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

What is claimed is:

1. A drive and guide device for a needle bar in a needle loom having a machine stand, the drive and guide device comprising:

a first crankshaft rotatably supported in the machine stand;

a needle bar supported in the machine stand to be movable at least up and down;

a first connecting rod supported on a first cam of the first crankshaft and connected to the needle bar; and a guide device for guiding the needle bar along a path extending substantially perpendicular to a needle-punching support surface, wherein at least one of the first connecting rod and the guide device comprises a leaf spring which is rigidly connected to the needle bar to transmit a drive or guide force.

2. The drive and guide device of claim 1 wherein the first connecting rod is rigidly connected to the needle bar, and the guide device comprises a guiding leaf spring arranged on substantially a same level as the needle bar, a first end of the guiding leaf spring being anchored on the machine stand, the second end of the guiding leaf spring being rigidly connected to the needle bar.

3. The drive and guide device of claim 1 wherein one end of a first connecting leaf spring is rigidly connected to a lower end of the first connecting rod facing away from the first cam, wherein a second end of the connecting leaf spring is rigidly attached to the needle bar, and wherein the guide device comprises a second crankshaft, which is arranged in the machine stand on substantially a same level as the needle bar and which has a second cam, on which a second connecting rod is supported, the second connecting rod being rigidly connected to the needle bar at an end facing away from the second cam.

4. The drive and guide device of claim 1 wherein the first connecting rod is rigidly connected to the needle bar, and wherein the guide device comprises a second crankshaft, which is arranged in the machine stand on substantially a same level as the needle bar and which has a second cam, on which a second connecting rod is supported, the second connecting rod having an end facing away from the second cam, to which end a first end of a connecting leaf spring is rigidly attached, a second end of the connecting leaf spring being rigidly connected to the needle bar.

5. The drive and guide device of claim 1 comprising:

two needle bars, which are supported parallel to each other in the machine stand and which are moved synchronously by two first crankshafts via two first connecting rods;

wherein the two first connecting rods are rigidly connected to the two needle bars;

wherein the two needle bars are connected to each other by a coupling leaf spring; and wherein the guide device comprises a guiding leaf spring extending on substantially a same level as the needle bar, which guiding leaf spring is anchored on the machine stand and rigidly connected to one of the two needle bars.

6. The drive and guide device of claim 1 comprising:

two needle bars, which are supported parallel to each other in the machine stand and which are moved synchronously by two first crankshafts via two first connecting rods;

wherein the two first crankshafts are set up to be driven in the same direction;

wherein each of the two first connecting rods comprises an end facing away from the first cam, to which end one end of a first connecting leaf spring is rigidly attached, a second end of the first connecting leaf spring being rigidly attached to one of the two needle bars;

wherein the two needle bars are connected to each other by two coupling leaf springs, which are arranged one above the other a certain distance apart and which are rigidly attached to the needle bars; and wherein the guide device comprises a guiding leaf spring, which extends substantially on a same level as the two needle bars, which is anchored at a first end on the machine stand, and which is rigidly connected at a second end to one of the two needle bars.

7. The drive and guide device of claim 1 comprising:

two needle bars, which are supported parallel to each other in the machine stand and which are moved synchronously by two first crankshafts via two first connecting rods;

wherein each of the two first connecting rods comprises an end facing away from the first cam, to which end a first end of a first connecting leaf spring is rigidly attached, which first connecting leaf spring has a second end, which is rigidly attached to one of the two needle bars;

wherein the two needle bars are connected to each other by two coupling leaf springs, which are arranged one above the other a certain distance apart and which are rigidly connected to the needle bars; and wherein the guide device comprises a second crankshaft, which is arranged in the machine stand on substantially a same level as the two needle bars, which second crankshaft has a second cam, on which a rigid, second connecting rod is supported, which second connecting rod has a first end facing away from the second cam, the first end being rigidly connected to the needle bar.

8. The drive and guide device of claim 2 wherein the anchoring of the guiding leaf spring on the machine stand is realized by a rigid connection.

9. The drive and guide device of claim 5 wherein the anchoring of the guiding leaf spring on the machine stand is realized by a rigid connection.

10. The drive and guide device of claim 6 wherein the anchoring of the guiding leaf spring on the machine stand is realized by a rigid connection.

11. The drive and guide device of claim 2 wherein the anchoring of the guiding leaf spring on the machine stand is realized by a pivot bearing.

12. The drive and guide device of claim 5 wherein the anchoring of the guiding leaf spring on the machine stand is realized by a pivot bearing.

13. The drive and guide device of claim 6 wherein the anchoring of the guiding leaf spring on the machine stand is realized by a pivot bearing.

14. The drive and guide device of claim 2 wherein the guiding leaf spring is surrounded by a guard, which reduces the deflection.

15. The drive and guide device of claim 6 wherein the guiding leaf spring is surrounded by a guard, which reduces the deflection.

16. The drive and guide device of claim 14 wherein the guard comprises two rails, which are parallel to each other and which rest on narrow sides of the guiding leaf spring, which rails are connected to each other by several pairs of rods arranged a certain distance apart, wherein the rods of each pair form a gap, through which the guiding leaf spring extends.

17. The drive and guide device of claim 15 wherein the guard comprises two rails, which are parallel to each other and which rest on narrow sides of the guiding leaf spring, which rails are connected to each other by several pairs of rods arranged a certain distance apart, wherein the rods of each pair form a gap, through which the guiding leaf spring extends.

18. The drive and guide device of claim 16 wherein the rails have a slightly C-shaped cross section with concave surfaces facing each other.

19. The drive and guide device of claim 17 wherein the rails have a slightly C-shaped cross section with concave surfaces facing each other.

20. The drive and guide device of claim 16 wherein the rails have ends, to which buffers of plastic or rubber are attached.

21. The drive and guide device of claim 17 wherein the rails have ends, to which buffers of plastic or rubber are attached.

* * * * *